US012140134B2

(12) United States Patent
Tanaka et al.

(10) Patent No.: US 12,140,134 B2
(45) Date of Patent: Nov. 12, 2024

(54) FLUID CONTROL APPARATUS

(71) Applicant: Murata Manufacturing Co., Ltd., Kyoto (JP)

(72) Inventors: Nobuhira Tanaka, Kyoto (JP); Yutoku Kawabata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 419 days.

(21) Appl. No.: 17/646,497

(22) Filed: Dec. 30, 2021

(65) Prior Publication Data

US 2022/0120268 A1 Apr. 21, 2022

Related U.S. Application Data

(63) Continuation of application No. PCT/JP2020/019176, filed on May 14, 2020.

(30) Foreign Application Priority Data

Jul. 3, 2019 (JP) ..... 2019-124101

(51) Int. Cl.
*F04B 43/04* (2006.01)
*F04B 43/00* (2006.01)

(52) U.S. Cl.
CPC ..... *F04B 43/046* (2013.01); *F04B 43/0054* (2013.01)

(58) Field of Classification Search
CPC ..... F04B 43/046; F04B 43/0054
See application file for complete search history.

(56) References Cited

U.S. PATENT DOCUMENTS

2006/0147329 A1 7/2006 Tanner
2009/0182261 A1* 7/2009 Seto ..... A61B 17/3203 606/170
2014/0248170 A1* 9/2014 Kabasawa ..... F04B 43/046 417/472
2017/0138357 A1 5/2017 Kondo et al.
(Continued)

FOREIGN PATENT DOCUMENTS

CN 201057136 Y 5/2008
EP 3751141 A1 12/2020
(Continued)

OTHER PUBLICATIONS

International Search Report for International Patent Application No. PCT/JP2020/019176 dated Jun. 30, 2020.

*Primary Examiner* — Connor J Tremarche
(74) *Attorney, Agent, or Firm* — Pearne & Gordon LLP

(57) ABSTRACT

A fluid control apparatus includes a first major plate, a piezoelectric device, a second major plate, a peripheral plate, a first film, and a second film. The first film is provided on a side of the first major plate that faces a pump chamber. The first film is provided on a first major surface in such a manner as to have a movable portion one end of which serves as a movable end. The second film is provided on a side of the second major plate that faces the pump chamber. The second film is provided on a third major surface in such a manner as to have a movable portion one end of which serves as a movable end. The first film and the second film are positioned between a first opening provided in the first major plate and a second opening provided in the second major plate.

20 Claims, 6 Drawing Sheets

(56) References Cited

U.S. PATENT DOCUMENTS

| | | | | |
|---|---|---|---|---|
| 2021/0010467 | A1* | 1/2021 | Fujisaki | F16K 15/14 |
| 2022/0381361 | A1* | 12/2022 | Kawabata | F16K 31/005 |

FOREIGN PATENT DOCUMENTS

| | | | |
|---|---|---|---|
| JP | 2008-527232 | A | 7/2008 |
| JP | 2017-072140 | A | 4/2017 |
| WO | 2016/013390 | A1 | 1/2016 |

* cited by examiner

FLUID CONTROL APPARATUS

CROSS REFERENCE TO RELATED APPLICATIONS

This is a continuation of International Application No. PCT/JP2020/019176 filed on May 14, 2020 which claims priority from Japanese Patent Application No. 2019-124101 filed on Jul. 3, 2019. The contents of these applications are incorporated herein by reference in their entireties.

BACKGROUND OF THE DISCLOSURE

Field of the Disclosure

The present disclosure relates to a fluid control apparatus utilizing a piezoelectric element.

Description of the Related Art

Hitherto, various fluid control apparatuses that transport fluids by utilizing piezoelectric elements have been developed, including the one disclosed in Patent Document 1.

The fluid control apparatus disclosed in Patent Document 1 includes a pump chamber and a valve chamber. The valve chamber includes a valve top plate, a valve bottom plate, and a film. The valve top plate and the valve bottom plate each have through-holes provided at positions not coinciding with the through-holes of the other plate. The valve chamber is connected to the pump chamber through the through-holes provided in the valve bottom plate.

The film is provided between the valve top plate and the valve bottom plate. The film has through-holes. The positions of the through-holes provided in the film coincide with the through-holes provided in the valve top plate. Therefore, when a fluid flows in from the pump chamber (through the through-holes of the valve bottom plate), the fluid is discharged to the outside through the through-holes of the film and the through-holes of the valve top plate. In contrast, when a fluid flows in from the through-holes of the valve top plate, the film closes the through-holes of the valve bottom plate, preventing the backflow of the fluid into the pump chamber. Thus, the fluid control apparatus disclosed in Patent Document 1 exerts a rectifying function.

Patent Document 1: Japanese Unexamined Patent Application Publication No. 2017-72140

BRIEF SUMMARY OF THE DISCLOSURE

In the fluid control apparatus disclosed in Patent Document 1, however, the path of the fluid is bent a plurality of times in the valve chamber. Therefore, a pressure loss is likely to occur, leading to a difficulty in exerting an improved flow characteristic.

Accordingly, an object of the present disclosure is to provide a fluid control apparatus that exerts an improved flow characteristic.

A fluid control apparatus according to the present disclosure includes a first major plate, a second major plate, a peripheral plate, and a pump chamber. The first major plate is a flat plate having a first major surface and a second major surface. The second major plate is a flat plate having a third major surface and a fourth major surface and is positioned such that the third major surface faces the first major surface. The peripheral plate connects the first major plate and the second major plate to each other. The pump chamber is enclosed by the first major plate, the second major plate, and the peripheral plate.

The first major plate includes a central portion, a frame portion, a supporting portion, and a first opening. The frame portion is provided around the circumference of the central portion. The supporting portion is connected to the frame portion and to the central portion and supports the central portion such that the central portion is vibratable. The first opening is provided between the central portion and the frame portion and connects the pump chamber and an outside area near the second major surface to each other. The second major plate includes a second opening that connects the pump chamber and an outside area near the fourth major surface to each other.

The fluid control apparatus further includes a piezoelectric device, a first film, and a second film. The piezoelectric device is provided on the central portion and vibrates the central portion. The first film is provided on the first major surface and includes a movable portion. One of the inner end and the outer end of the movable portion serves as a fixed end, and the other end serves as a movable end. The second film is provided on the third major surface and includes a movable portion. One of the inner end and the outer end of the movable portion that is on the same side as the one end of the first film serves as a fixed end, and the other end serves as a movable end. The first film and the second film are positioned between the first opening and the second opening.

In the above configuration, the first film and the second film deform in accordance with the direction in which a fluid flows. The state of the deformation is switchable between a state where the fluid is allowed to flow in through the second opening for the pump chamber and a state where the fluid is allowed to flow out through the first opening: specifically, between a state where spaces on the center side and the outer side of the pump chamber are closed to each other (separated from each other) and a state where the two spaces are open to each other. Thus, a rectifying characteristic is produced. In the above configuration, the first film and the second film coincide with each other at least in part in plan view. Therefore, even if the movable ranges of the first film and the second film are small, the two spaces are closable to each other. Furthermore, when the two spaces are open to each other, a wide opening is provided between the two spaces even if the movable ranges of the first film and the second film are small.

According to the present disclosure, an improved flow characteristic is exerted.

DETAILED DESCRIPTION OF THE DISCLOSURE

First Embodiment

Figure 1:
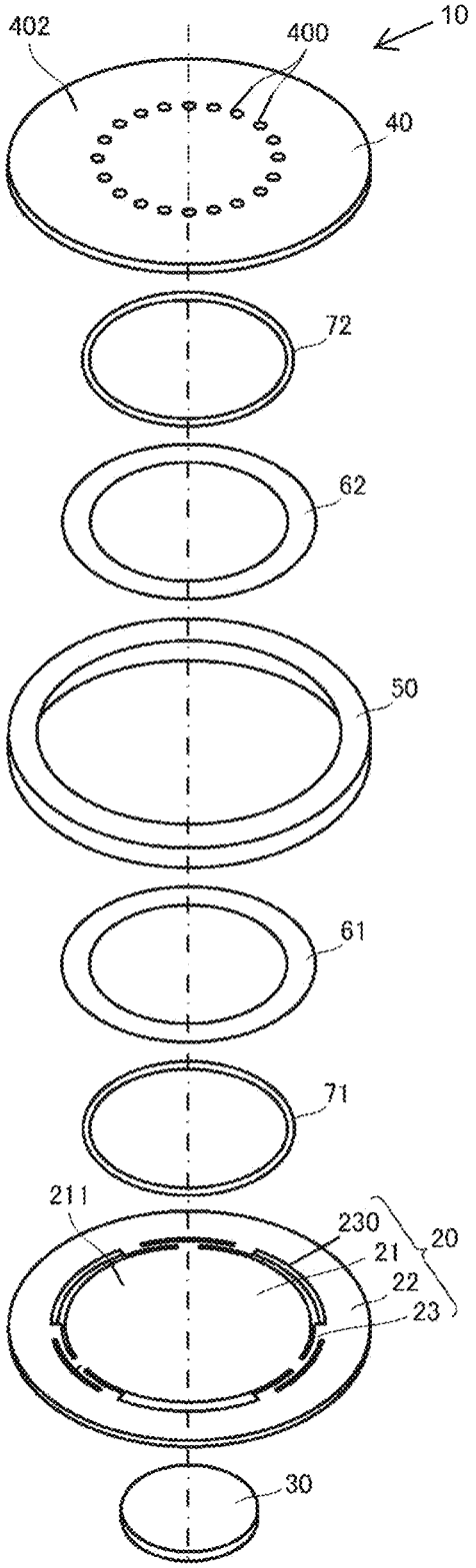
FIG. 1 is an exploded perspective view of a fluid control apparatus according to a first embodiment.
Figure 2A:
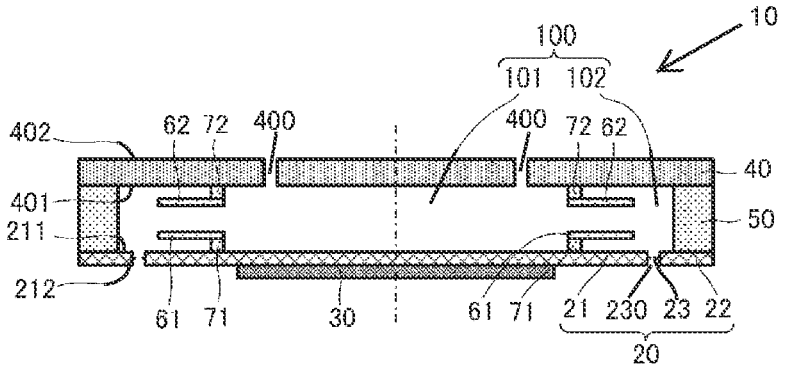
FIG. 2A is a sectional view of the fluid control apparatus according to the first embodiment.
Figure 2B:
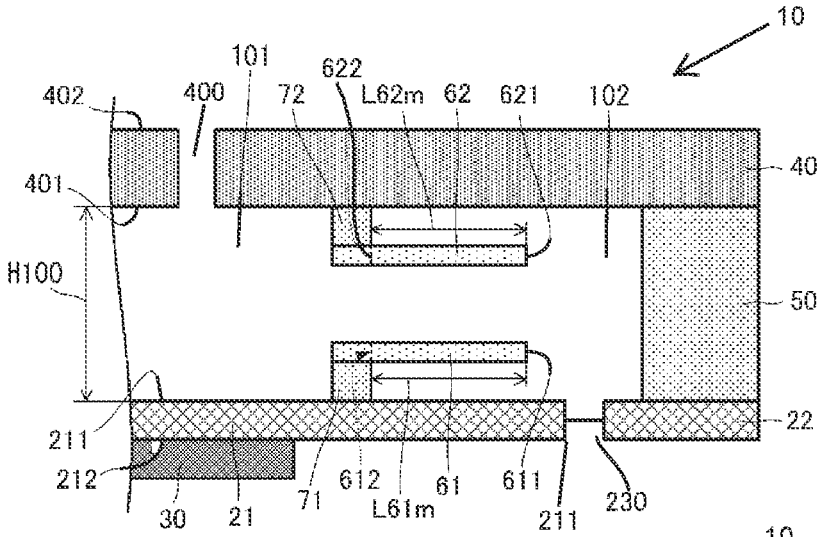
FIG. 2B is an enlarged sectional view of a part where a rectifying function is to be exerted.
Figure 3A:
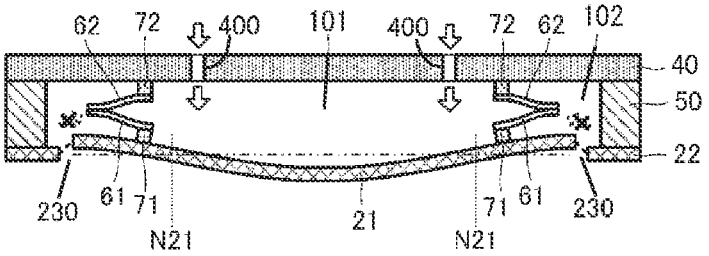
FIGS. 3A and 3B are side sectional views illustrating how a central portion of a first major plate, a first film and a second film behave.
Figure 3B:
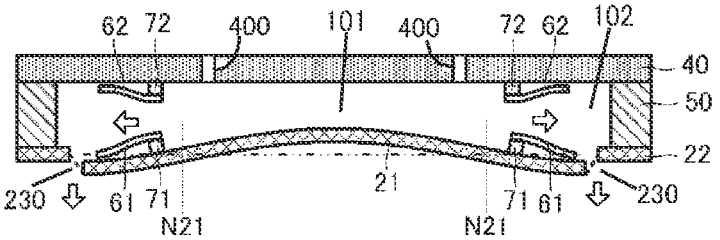

A fluid control apparatus according to a first embodiment of the present disclosure will now be described with reference to relevant drawings. FIG. 1 is an exploded perspective view of a fluid control apparatus according to the first embodiment. FIG. 2A is a sectional view of the fluid control apparatus according to the first embodiment. FIG. 2B is an enlarged sectional view of a part where a rectifying function is to be exerted. FIGS. 3A and 3B are side sectional views illustrating how a central portion of a first major plate, a first film and a second film behave. In the drawings to be referred to in the following description of embodiments, the shapes of relevant elements are partially or generally exaggerated for easy understanding of the description. For easy reading of the drawings, reference signs of some elements that are uniquely assumable are omitted.

(Configuration of Fluid Control Apparatus 10)

As illustrated in FIGS. 1, 2A, and 2B, the fluid control apparatus, 10, includes a first major plate 20, a piezoelectric device 30, a second major plate 40, a peripheral plate 50, a first film 61, a second film 62, a fixing member 71, and a fixing member 72.

The first major plate 20 is a flat plate having a circular plan-view shape. The first major plate 20 has a first major surface 211 and a second major surface 212, each of which has a circular shape. The first major surface 211 and the second major surface 212 are positioned opposite to each other.

The first major plate 20 includes a central portion 21, a frame portion 22, a supporting portion 23, and a first opening 230. The central portion 21 has a circular plan-view shape. The frame portion 22 has an annular shape. The frame portion 22 extends along the circumference of the central portion 21 and surrounds the central portion 21.

The supporting portion 23 and the first opening 230 extend along the circumferential end of the central portion 21 and between the central portion 21 and the frame portion 22. The first opening 230 is a cut extending through the first major plate 20 between the first major surface 211 and the second major surface 212.

The supporting portion 23 connects the circumferential end of the central portion 21 and the inner circumferential end of the frame portion 22 to each other. The supporting portion 23 is, for example, one of a plurality of supporting portions 23. In the embodiment illustrated in FIG. 1, the plurality of supporting portions 23 are provided at intervals of 90° along the circumference of the central portion 21. In the fluid control apparatus 10, the supporting portions 23 section the cut, serving as the first opening 230, into a plurality of first openings 230 at any positions in the circumferential direction. The width and shape of the supporting portions 23 are determined according to need, whereby the central portion 21 is vibratable with respect to the frame portion 22. In other words, the supporting portions 23 support the central portion 21 such that the central portion 21 is vibratable with respect to the frame portion 22.

The central portion 21 preferably has a circular shape but may have a substantially circular shape such as an oval shape, or a polygonal shape. The outline shape of the frame portion 22, i.e., the outline shape of the first major plate 20, is not limited to a circular shape and may be determined according to need in coordination with the outline shape of the fluid control apparatus 10.

The first major plate 20 is made of metal, for example. The first major plate 20 only needs to be capable of undergoing bending vibration in the central portion 21 thereof when the piezoelectric device 30, to be described below, is strained. Bending vibration refers to vibration in which the first major surface 211 and the second major surface 212 are displaced in such a manner as to wave in a side view of the central portion 21, as illustrated in FIGS. 3A and 3B.

The piezoelectric device 30 includes a disc-shaped piezoelectric element and driving electrodes. The driving electrodes are provided on the two major surfaces, respectively, of the disc-shaped piezoelectric element.

The piezoelectric device 30 is provided on the second major surface 212 of the first major plate 20 at the central portion 21. In plan view, the center of the piezoelectric device 30 and the center of the central portion 21 substantially coincide with each other. The piezoelectric device 30 is strained when a driving signal is applied to the driving electrodes thereof. With the strain, the central portion 21 vibrates as described above.

The second major plate 40 is a flat plate having a circular plan-view shape. The material, thickness, and other relevant factors of the second major plate 40 are preferably determined such that the second major plate 40 undergoes substantially no bending vibration. The outline shape of the second major plate 40 is large enough to cover the outline shape of the first major plate 20. The second major plate 40 has a third major surface 401 and a fourth major surface 402, each of which has a circular shape. The third major surface 401 and the fourth major surface 402 are positioned opposite to each other.

The second major plate 40 has a plurality of second openings 400. The plurality of second openings 400 are cylindrical through-holes extending through the second major plate 40 between the third major surface 401 and the fourth major surface 402. The plurality of second openings 400 are arranged on a circle having the origin thereof at the center of the second major plate 40.

The second major plate 40 is positioned such that the major surfaces thereof extend parallel to the major surfaces of the first major plate 20. In this state, the third major surface 401 of the second major plate 40 and the first major surface 211 of the first major plate 20 face each other. Furthermore, the plan-view center of the second major plate 40 and the plan-view center of the central portion 21 of the first major plate 20 substantially coincide with each other.

As with the case of the first major plate 20, the outline shape of the second major plate 40 is not limited to a circular shape and may be determined according to need in coordination with the outline shape of the fluid control apparatus 10.

The peripheral plate 50 is an annular column. The material, thickness, and other relevant factors of the peripheral plate 50 are preferably determined such that the peripheral plate 50 undergoes substantially no bending vibration. The peripheral plate 50 may be either separate from or integrated with each of the first major plate 20 and the second major plate 40.

The peripheral plate 50 is positioned between the first major plate 20 and the second major plate 40. One height-direction end of the peripheral plate 50 is connected to the first major surface 211 of the first major plate 20 at the frame portion 22. The other height-direction end of the peripheral plate 50 is connected to the third major surface 401 of the second major plate 40.

The fluid control apparatus 10 configured as above has a space enclosed by the first major plate 20, the second major plate 40, and the peripheral plate 50. The space serves as a pump chamber 100 of the fluid control apparatus 10.

The first film 61 and the second film 62 each have an annular shape. The first film 61 and the second film 62 are each made of a flexible material and each bend when receiving an external force. The first film 61 and the second film 62 have substantially the same shape.

The inner-end diameter (inside diameter) of the first film 61 and the second film 62 is greater than the diameter of the circle on which the plurality of second openings 400 are arranged. The outer-end diameter (outside diameter) of the first film 61 and the second film 62 is smaller than the diameter of the central portion 21.

The fixing member 71 and the fixing member 72 each have an annular shape. The fixing member 71 and the fixing member 72 have substantially the same shape. The inside diameter of the fixing member 71 and the fixing member 72 is substantially equal to the inside diameter of the first film 61 and the second film 62. The outside diameter of the fixing member 71 and the fixing member 72 is smaller than the outside diameter of the first film 61 and the second film 62.

The first film 61 is fixed to the first major surface 211 of the first major plate 20 with the fixing member 71 interposed therebetween. The first film 61 is fixed to the central portion 21. The center of the first film 61 substantially coincides with the center of the central portion 21.

Specifically, a portion of the first film 61 that is at the inner end and has a predetermined area is fixed to the first major plate 20 with the fixing member 71 interposed therebetween. Therefore, the other portion of the first film 61 that is on the outer side and is not connected to the fixing member 71 serves as a movable portion of the first film 61. That is, the inner end of the first film 61 serves as a fixed end, while the outer end of the first film 61 serves as a movable end.

The second film 62 is fixed to the third major surface 401 of the second major plate 40 with the fixing member 72 interposed therebetween. The center of the second film 62 substantially coincides with the center of the second major plate 40 (the center of the circle on which the plurality of second openings 400 are arranged).

Specifically, a portion of the second film 62 that is at the inner end and has a predetermined area is fixed to the second major plate 40 with the fixing member 72 interposed therebetween. Therefore, the other portion of the second film 62 that is on the outer side and is not connected to the fixing member 72 serves as a movable portion of the second film 62. That is, the inner end of the second film 62 serves as a fixed end, while the outer end of the second film 62 serves as a movable end.

Thus, the fluid control apparatus 10 includes, in the pump chamber 100, the first film 61 and the second film 62 each having the movable portion.

In the plan view of the fluid control apparatus 10 (when seen in a direction orthogonal to the major surfaces of the first major plate 20 and the second major plate 40), the first film 61 and the second film 62 are at substantially the same position. That is, in the plan view of the fluid control apparatus 10, the first film 61 and the second film 62 coincide with each other, and the movable portion of the first film 61 and the movable portion of the second film 62 coincide with each other. Accordingly, the movable portion of the first film 61 and the movable portion of the second film 62 face each other.

In the plan view of the fluid control apparatus 10 configured as above, the first film 61 and the second film 62 are positioned between the first openings 230 and the second openings 400. The pump chamber 100 is sectioned into a first space 101 that is on the center side with respect to the first film 61 and the second film 62, and a second space 102 that is on the outer side with respect to (closer to the peripheral plate 50 than) the first film 61 and the second film 62. The first space 101 is continuous with the second openings 400. The second space 102 is continuous with the first openings 230.

(Specific Description of Rectifying Function)

In the above configuration, when the central portion 21 vibrates, the fluid control apparatus 10 alternately takes a first state illustrated in FIG. 3A and a second state illustrated in FIG. 3B, generally.

1. How Fluid Flows from Outside into Pump Chamber

In the first state illustrated in FIG. 3A, a part of the central portion 21 that is on the center side with respect to a node N21 is displaced away from the second major plate 40. Meanwhile, a part of the central portion 21 that is on the outer side with respect to the node N21 is displaced toward the second major plate 40. Therefore, the first space 101 on the center side of the central portion 21 comes to have a pressure lower than (negative to) the pressure on the outside of the fluid control apparatus 10 and the pressure in the second space 102.

Since the first space 101 has a low (negative) pressure, the fluid in an area outside the fluid control apparatus 10 and near the second major plate 40 flows into the first space 101 through the second openings 400. The fluid on the outside also moves to flow into the first space 101 through the first openings 230 and the second space 102.

Here, the first film 61 and the second film 62 each have the inner end serving as the fixed end and the outer end serving as the movable portion. Therefore, when the first space 101 is under a negative pressure, as illustrated in FIG. 3A, the first film 61 bends toward the second major plate 40, i.e., toward the second film 62, whereas the second film 62 bends toward the first major plate 20, i.e., toward the first film 61. Then, as illustrated in FIG. 3A, the movable portion of the first film 61 and the movable portion of the second film 62 come into contact with each other at the outer ends thereof. Consequently, the first space 101 and the second space 102 are closed to each other (separated from each other). Thus, the fluid on the outside is prevented from flowing into the first space 101 through the first openings 230 and the second space 102.

2. How Fluid is Discharged from Pump Chamber to Outside

In the second state illustrated in FIG. 3B, the part of the central portion 21 that is on the center side with respect to the node N21 is displaced toward the second major plate 40. Meanwhile, the part of the central portion 21 that is on the outer side with respect to the node N21 is displaced away from the second major plate 40. Therefore, the first space 101 on the center side of the central portion 21 comes to have a pressure higher than (positive to) the pressure in the second space 102.

Since the first space 101 has a high (positive) pressure, the fluid flows in such a manner as to push the movable portion of the first film 61 and the movable portion of the second film 62 away from each other. Therefore, the movable portion of the first film 61 bends toward the first major plate 20, whereas the movable portion of the second film 62 bends toward the second major plate 40. Consequently, the first space 101 and the second space 102 are opened to each other. Thus, the fluid in the first space 101 flows into the second space 102 and is discharged from the second space 102 through the first openings 230 to an area outside the fluid control apparatus 10 and near the second major surface 212.

Here, the plurality of second openings 400 each have a size (in side view) that is smaller, preferably satisfactorily smaller, than the size of the space between the first film 61 and the second film 62. Therefore, substantially none of the fluid in the first space 101 is discharged to the outside through the first openings 230.

As described above, the fluid control apparatus 10 is capable of causing a fluid to flow unidirectionally. With the fluid control apparatus 10 configured as above, the fluid flows without being bent at the rectifying portion (the location where the first film 61 and the second film 62 are provided). Therefore, an improved flow characteristic is exerted.

As described above, the fluid control apparatus 10 includes the first film 61 and the second film 62 provided at positions that coincide with each other in plan view. Therefore, even if the movable ranges of the first film 61 and the movable range of the second film 62 are small, the first space 101 and the second space 102 are closable to each other. Hence, in the fluid control apparatus 10, the switching between the closed state and the open state is achieved at a high speed, enhancing the effect of backflow prevention. Consequently, the fluid control apparatus 10 exerts a further improved flow characteristic.

Figure 4:
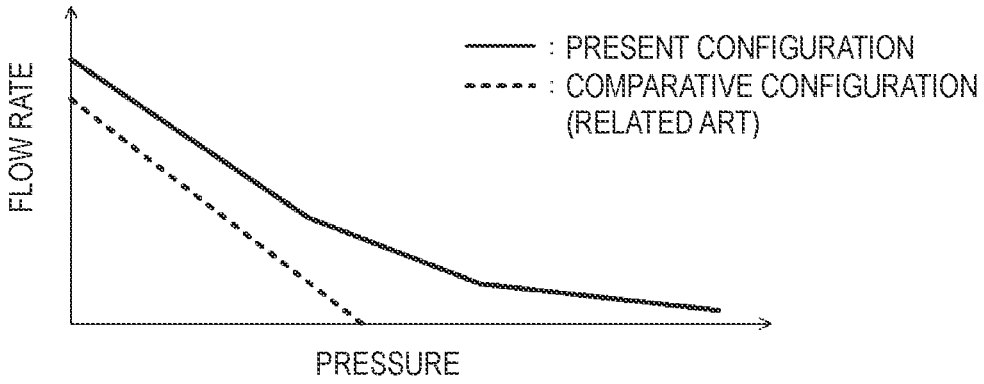
FIG. 4 is a graph illustrating the flow characteristics exerted by the present configuration and a comparative configuration.

FIG. 4 is a graph illustrating flow characteristics exerted by the present configuration and a comparative configuration. In FIG. 4, the horizontal axis represents pressure, and the vertical axis represents flow rate. In FIG. 4, the solid line represents the characteristic of the present configuration, and the broken line represents the characteristic of the comparative configuration. The comparative configuration is the configuration according to the related art described above. As illustrated in FIG. 4, employing the present configuration improves the flow characteristic.

In the fluid control apparatus 10, the movable portion of each of the first film 61 and the second film 62 is on the outer side with respect to (closer to the peripheral plate 50 than) the fixed portion. Therefore, the size of the opening where the rectifying function is to be exerted is increased. Herein, the size of the opening refers to the size of a plane extending orthogonal to the direction in which the fluid generally flows and is the size of a lateral face of a cylinder that is orthogonal to the first major surface 211 and the third major surface 401. With the opening having an increased size, when the fluid is transported (discharged) from the first space 101 to the second space 102, the energy exerted by the fluid is reduced. Therefore, the fluid control apparatus 10 has a reduced loss of energy at the time of discharge.

Furthermore, in the fluid control apparatus 10, the movable portion of the first film 61 and the movable portion of the second film 62 coincide with each other substantially over the entirety in plan view. Hence, in the fluid control apparatus 10, the switching between the closed state and the open state is achieved at a higher speed and assuredly. Consequently, the fluid control apparatus 10 exerts a further improved flow characteristic. Note that the flow characteristic is improved as long as the movable portion of the first film 61 and the movable portion of the second film 62 coincide with each other at least in part.

In the fluid control apparatus 10, the first film 61 and the second film 62 are positioned on the outer side with respect to the node N21 of vibration of the central portion 21. Therefore, in the state where the first space 101 and the second space 102 are closed to each other, the part of the central portion 21 where the first film 61 is provided is displaced toward the second major plate 40. Hence, the first film 61 and the second film 62 are easily brought into contact with each other. In the other state where the first space 101 and the second space 102 are open to each other, the part of the central portion 21 where the first film 61 is provided is displaced away from the second major plate 40. Hence, the gap between the first film 61 and the second film 62 is widened, that is, the size of the opening therebetween is increased. Consequently, the fluid control apparatus 10 exerts a much further improved flow characteristic.

In the above configuration, even when the first film 61 is deformed, the outer end of the first film 61 does not interfere with the outer edge of the central portion 21 at the first openings 230. Therefore, the damage to the first film 61 is reduced, and the reliability of the fluid control apparatus 10 is increased.

The shape of the movable portion of the first film 61 and the shape of the movable portion of the second film 62 preferably satisfy the following conditions.

The length (distance) of the first film 61 between a movable end 611, which is the outer end, and a fixed end 612, which is a point near the inner end and is connected to the fixing member 71, is denoted as L61*m*. The fixed end 612 is an end of a surface area where the first film 61 is fixed to the fixing member 71, and adjoins the movable portion. The length (distance) of the second film 62 between a movable end 621, which is the outer end, and a fixed end 622, which is a point near the inner end and is connected to the fixing member 72, is denoted as L62*m*. The fixed end 622 is an end of a surface area where the second film 62 is fixed to the fixing member 72, and adjoins the movable portion. The length L61*m* and the length L62*m* are substantially equal, preferably equal.

The shape of the movable portion of the first film 61, the shape of the movable portion of the second film 62, and the height of the pump chamber 100 preferably satisfy the following relationship.

The height of the pump chamber 100, i.e., the distance between the first major surface 211 of the first major plate 20 and the third major surface 401 of the second major plate 40, is denoted as H100. The sum of the length L61*m* of the movable portion of the first film 61 and the length L62*m* of the movable portion of the second film 62 is greater than or equal to the height H100. Therefore, in the closed state, the movable portion of the first film 61 and the movable portion of the second film 62 assuredly come into contact with each other. Consequently, the fluid control apparatus 10 more assuredly exerts an improved flow characteristic.

Preferably, the sum of the length L61*m* of the movable portion of the first film 61 and the length L62*m* of the movable portion of the second film 62 is substantially equal to the height H100. In such a configuration, the movable portion of the first film 61 and the movable portion of the second film 62 are allowed to come into contact with each other with a reduced range of movement thereof. Hence, in the fluid control apparatus 10, the switching between the two states for rectification control is achieved at a higher speed and with a small loss.

Second Embodiment

Figure 5:
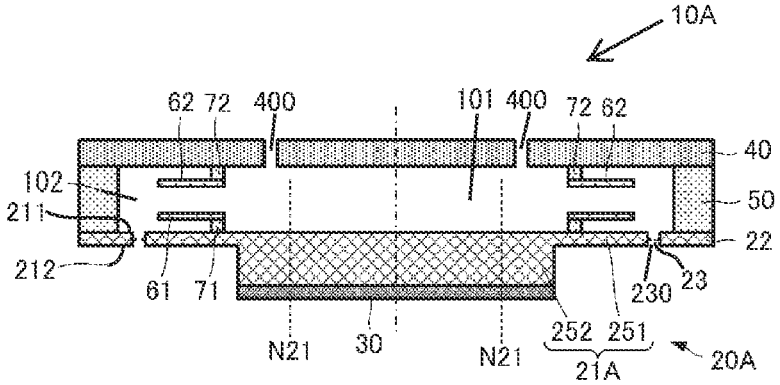
FIG. 5 is a sectional view of a fluid control apparatus according to a second embodiment.

A fluid control apparatus according to a second embodiment will now be described with reference to a relevant drawing. FIG. 5 is a sectional view of the fluid control apparatus according to the second embodiment.

As illustrated in FIG. 5, the fluid control apparatus, 10A, according to the second embodiment is different from the fluid control apparatus 10 according to the first embodiment in the shape of the central portion, 21A, of the first major plate, 20A. The other details of the fluid control apparatus 10A are the same as those of the fluid control apparatus 10, and description of such details is omitted.

The central portion 21A of the first major plate 20A includes a first region 251 and a second region 252. The second region 252 is thicker than the first region 251. The second region 252 projects from the second major surface 212 with respect to the first region 251, whereby the thickness difference is produced. The average thickness of the central portion 21A is greater on the inner side with respect to the node N21 of vibration than on the outer side with respect to the node N21. The piezoelectric device 30 is provided on the second region 252.

With such a configuration, the vibration waveform of the central portion 21A (the way of deformation of the central portion 21A) is controllable. Specifically, the displacement of the central portion 21A due to the vibration is greater near the circumference. Thus, the deformation of the first film 61 is promoted, and the efficiency of rectification by the fluid control apparatus 10A is increased. Consequently, the fluid control apparatus 10A exerts a further improved flow characteristic.

Third Embodiment

Figure 6:
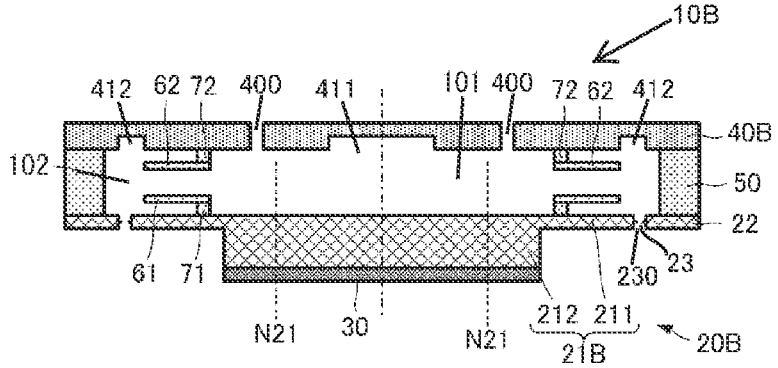
FIG. 6 is a sectional view of a fluid control apparatus according to a third embodiment.

A fluid control apparatus according to a third embodiment will now be described with reference to a relevant drawing. FIG. 6 is a sectional view of the fluid control apparatus according to the third embodiment.

As illustrated in FIG. 6, the fluid control apparatus, 10B, according to the third embodiment is different from the fluid control apparatus 10A according to the second embodiment in the configuration of the second major plate, 40B. The other details of the fluid control apparatus 10B are the same as those of the fluid control apparatus 10A, and description of such details is omitted.

The second major plate 40B has a recess 411 and a recess 412. The recess 411 and the recess 412 are depressions that are open in the third major surface 401 of the second major plate 40B. The space provided in the recess 411 has a round columnar shape. The space provided in the recess 412 has an annular columnar shape. The recess 411 is continuous with the first space 101. The recess 412 is continuous with the second space 102.

Such a configuration suppresses the interference between the central portion 21A and the second major plate 40B that may occur when the central portion 21A vibrates. Consequently, the fluid control apparatus 10B has improved durability with low noise.

Fourth Embodiment

Figure 7A:
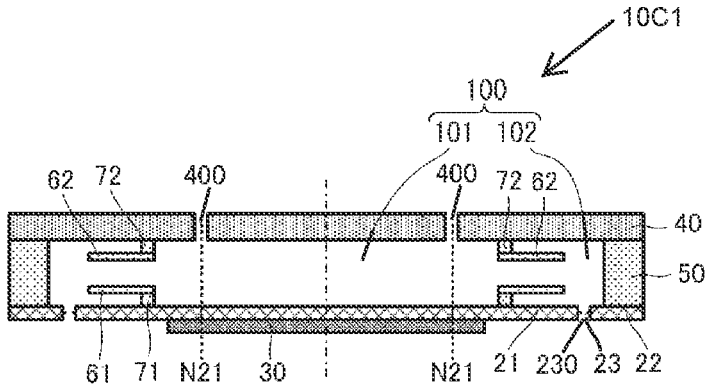
FIGS. 7A and 7B are sectional views of fluid control apparatuses according to a fourth embodiment.
Figure 7B:
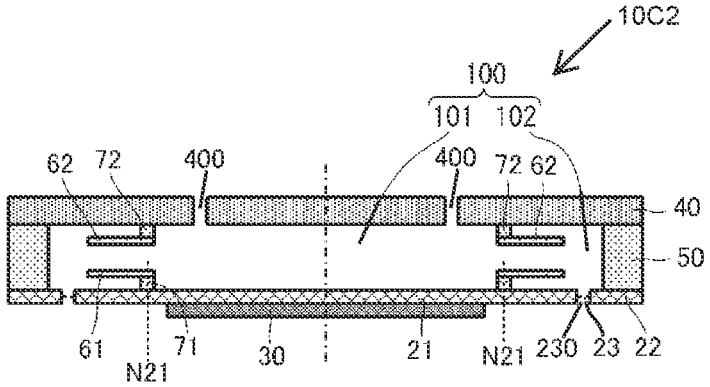

Fluid control apparatuses according to a fourth embodiment will now be described with reference to relevant drawings. FIGS. 7A and 7B are sectional views of the fluid control apparatuses according to the fourth embodiment.

As illustrated in FIGS. 7A and 7B, the fluid control apparatuses, 10C1 and 10C2, according to the fourth embodiment are different from the fluid control apparatus 10 according to the first embodiment in the positional relationship between the node N21 and relevant elements. The other details of the fluid control apparatuses 10C1 and 10C2 are the same as those of the fluid control apparatus 10, and description of such details is omitted.

In the fluid control apparatus 10C1 illustrated in FIG. 7A, the node N21 and the second openings 400 coincide with each other. In the fluid control apparatus 10C1 having such a configuration, the fluid in the first space 101 is prevented from flowing backward to the outside through the second openings 400 at the time of fluid discharge. The node N21 and the second openings 400 preferably coincide with each other in plan view but may be close to each other in plan view.

In the fluid control apparatus 10C2 illustrated in FIG. 7B, the node N21 and the fixing member 71 coincide with each other. In the fluid control apparatus 10C2 having such a configuration, the fixing member 71 does not receive the energy of vibration of the central portion 21. Therefore, the state of joining or bonding between the fixing member 71 and the central portion 21 is less likely to be deteriorated. Consequently, the fluid control apparatus 10C2 is less likely to be damaged, providing high reliability. The node N21 and the fixing member 71 preferably coincide with each other but may be close to each other in plan view. The position of the node N21 is detectable with a device such as a laser displacement gauge that utilizes the Doppler effect.

Fifth Embodiment

Figure 8:
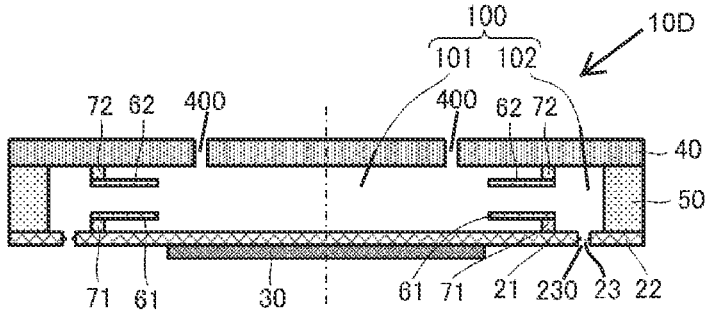
FIG. 8 is a sectional view of a fluid control apparatus according to a fifth embodiment.

A fluid control apparatus according to a fifth embodiment will now be described with reference to a relevant drawing. FIG. 8 is a sectional view of the fluid control apparatus according to the fifth embodiment.

As illustrated in FIG. 8, the fluid control apparatus, 10D, according to the fifth embodiment is different from the fluid control apparatus 10 according to the first embodiment in the way of fixing the first film 61 and the second film 62. The other details of the fluid control apparatus 10D are the same as those of the fluid control apparatus 10, and description of such details is omitted.

In the fluid control apparatus 10D, the first film 61 is fixed to the first major plate 20 at the outer end thereof with the fixing member 71 interposed therebetween. That is, in the fluid control apparatus 10D, the outer end of the first film 61 serves as a fixed end, and the inner end of the first film 61 serves as a movable end. The second film 62 is fixed to the second major plate 40 at the outer end thereof with the fixing member 72 interposed therebetween. That is, in the fluid control apparatus 10D, the outer end of the second film 62 serves as a fixed end, and the inner end of the second film 62 serves as a movable end.

The fluid control apparatus 10D having such a configuration also exerts a rectifying function and thus an improved flow characteristic.

Sixth Embodiment

Figure 9:
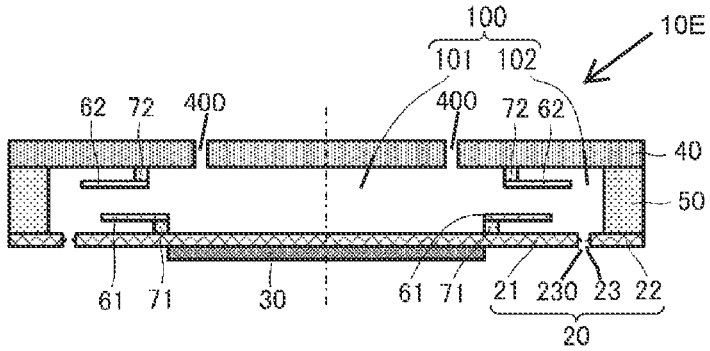
FIG. 9 is a sectional view of a fluid control apparatus according to a sixth embodiment.

A fluid control apparatus according to a sixth embodiment will now be described with reference to a relevant drawing. FIG. 9 is a sectional view of the fluid control apparatus according to the sixth embodiment.

As illustrated in FIG. 9, the fluid control apparatus, 10E, according to the sixth embodiment is different from the fluid control apparatus 10 according to the first embodiment in the positional relationship between the first film 61 and the second film 62. The other details of the fluid control apparatus 10E are the same as those of the fluid control apparatus 10, and description of such details is omitted.

In the fluid control apparatus 10E, the fixing member 72 has a larger diameter than the fixing member 71. Therefore, the fixing member 72 is closer to the peripheral plate 50 than the fixing member 71. Accordingly, the second film 62 is closer to the peripheral plate 50 than the first film 61. In other words, the second film 62 is closer to the circumferences of the first major plate 20 and the second major plate 40 than the first film 61.

In such a configuration, the second film 62 and the first film 61 partially coincide with each other in plan view.

The fluid control apparatus 10E having such a configuration also exerts a rectifying function and thus an improved flow characteristic. In such a configuration, the movable portion of the first film 61 is preferably longer than the movable portion of the second film 62. More preferably, the movable portion of the first film 61 extends over the entire area coinciding with the movable portion of the second film 62. The fluid control apparatus 10E having such a configuration more assuredly exerts a rectifying function and thus a further improved flow characteristic.

In the present embodiment, the second film 62 is positioned closer to the peripheral plate 50 than the first film 61. Alternatively, the first film 61 may be positioned closer to the peripheral plate 50 than the second film 62. In such a case, the deformation of the first film 61 is further promoted.

Seventh Embodiment

Figure 10:
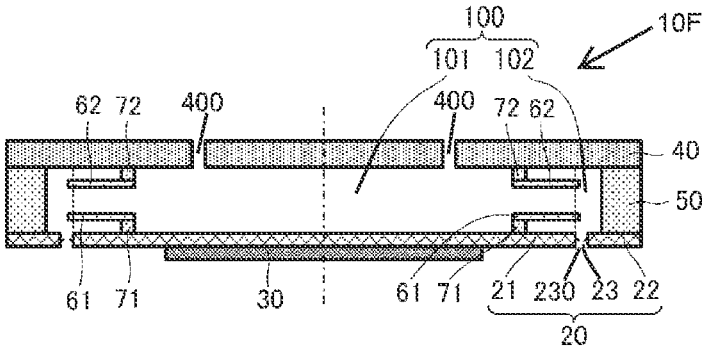
FIG. 10 is a sectional view of a fluid control apparatus according to a seventh embodiment.

A fluid control apparatus according to a seventh embodiment will now be described with reference to a relevant drawing. FIG. 10 is a sectional view of the fluid control apparatus according to the seventh embodiment.

As illustrated in FIG. 10, the fluid control apparatus, 10F, according to the seventh embodiment is different from the fluid control apparatus 10 according to the first embodiment in the way of arrangement of the first film 61 and the second film 62. The other details of the fluid control apparatus 10F are the same as those of the fluid control apparatus 10, and description of such details is omitted.

In the fluid control apparatus 10F, the movable end of the first film 61 and the movable end of the second film 62 are positioned on the outer side with respect to (closer to the peripheral plate 50 than) the circumferential end of the central portion. The fluid control apparatus 10F having such a configuration also exerts a rectifying function and thus an improved flow characteristic.

Eighth Embodiment

Figure 11:
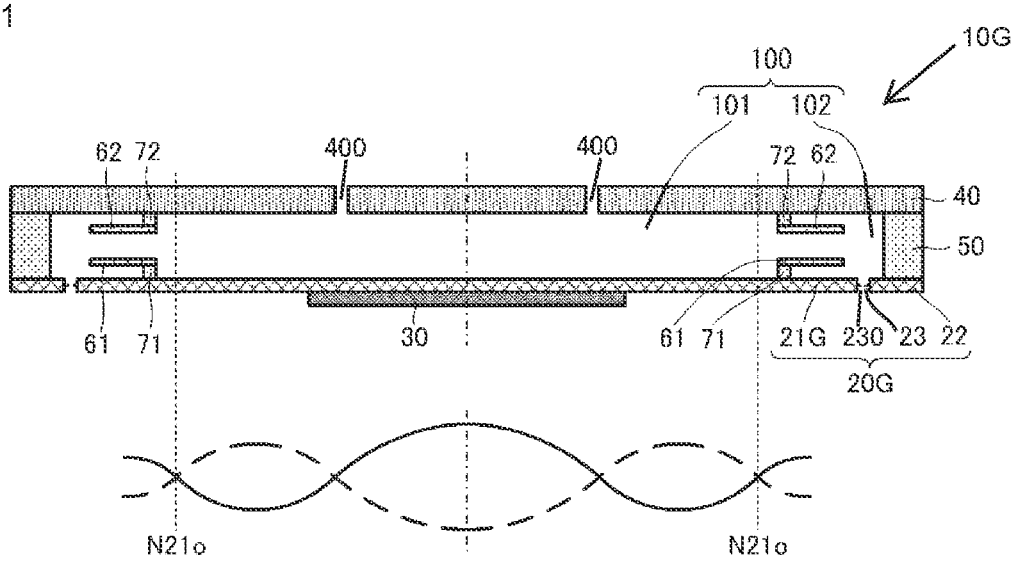
FIG. 11 is a sectional view of a fluid control apparatus according to an eighth embodiment.

A fluid control apparatus according to an eighth embodiment will now be described with reference to a relevant drawing. FIG. 11 is a sectional view of the fluid control apparatus according to the eighth embodiment. In FIG. 11, the upper part illustrates the configuration of the fluid control apparatus, and the lower part (a waveform chart) illustrates an exemplary vibration waveform of the first major plate.

The fluid control apparatus, 10G, according to the eighth embodiment illustrated in FIG. 11 utilizes secondary vibration, unlike the fluid control apparatus 10 according to the first embodiment that utilizes primary vibration. The other details of the fluid control apparatus 10G are the same as those of the fluid control apparatus 10, and description of such details is omitted.

In the fluid control apparatus 10G, a central portion 21G of a first major plate 20G undergoes secondary vibration. Secondary vibration is generatable by adjusting the shapes and weights of relevant elements, including the first major plate 20G, of the fluid control apparatus 10G and the driving conditions of the piezoelectric device 30.

In such a configuration, the first film 61 and the second film 62 are positioned on the outer side with respect to (closer to the peripheral plate 50 than) a node N21*o*, which is the outermost node of secondary vibration.

The fluid control apparatus 10G having such a configuration also exerts a rectifying function and thus an improved flow characteristic.

In the present embodiment, at least the movable ends of the first film 61 and the second film 62 only need to be positioned on the outer side with respect to the outermost node N210 of secondary vibration.

While the present embodiment concerns a configuration utilizing secondary vibration, a configuration utilizing vibration of another order may alternatively be employed. In that case, it is only necessary that the movable ends of the first film 61 and the movable ends of the second film 62 are positioned on the outer side with respect to the outermost node of vibration.

Ninth Embodiment

Figure 12:
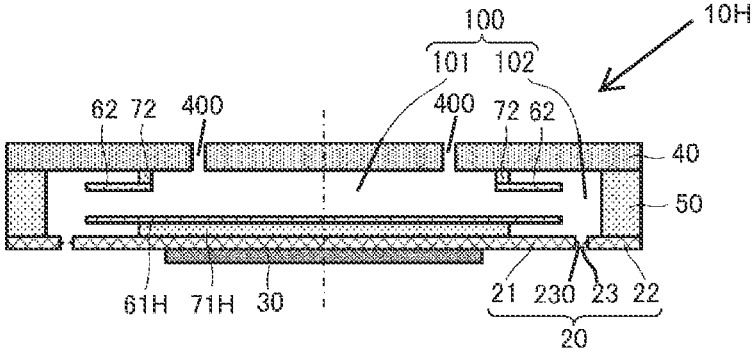
FIG. 12 is a sectional view of a fluid control apparatus according to a ninth embodiment.

A fluid control apparatus according to a ninth embodiment will now be described with reference to a relevant drawing. FIG. 12 is a sectional view of the fluid control apparatus according to the ninth embodiment.

As illustrated in FIG. 12, the fluid control apparatus, 10H, according to the ninth embodiment is different from the fluid control apparatus 10 according to the first embodiment in the shape of the first film, 61H, and the fixing member, 71H. The other details of the fluid control apparatus 10H are the same as those of the fluid control apparatus 10, and description of such details is omitted.

In the fluid control apparatus 10H, the first film 61H is a circular film. The fixing member 71H has a round columnar shape with a diameter smaller than that of the first film 61. The first film 61H is fixed to the first major surface 211 of the central portion 21 with the fixing member 71H interposed therebetween and over substantially the entire area of the central portion 21 that faces the first space 101. Thus, the strength of fixing the first film 61H to the central portion 21 is increased.

The fluid control apparatus 10H having such a configuration also exerts a rectifying function and thus an improved flow characteristic. Furthermore, the first film 61H is less likely to peel off, which increases the reliability of the fluid control apparatus 10H.

(Exemplary Shapes of Supporting Portions)

The shape of the supporting portions, which has not been described in detail above, may be any of those illustrated in FIGS. 13A, 13B, 13C, 13D, and 13E, for example. FIGS. 13A, 13B, 13C, 13D, and 13E are plan views of first major plates, illustrating different arrangements of supporting portions and elements therearound.

Figure 13A:
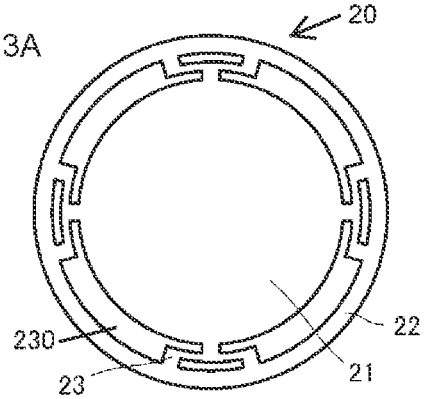
FIGS. 13A, 13B, 13C, 13D, and 13E are plan views of first major plates, illustrating different arrangements of supporting portions and elements therearound.

FIG. 13A illustrates the first major plate 20 configured as illustrated in FIG. 1. The supporting portions 23 of the first major plate 20 include first segments connected to the central portion 21, second segments connected to the frame portion 22, and third segments connecting the first segments and the second segments to each other. The first segments and the second segments each extend in such a direction as to connect the circumferential end of the central portion 21 and the frame portion by the shortest distance. Each of the first segments is provided with two second segments. The two second segments are arranged symmetrically with respect to an axis extending in the direction in which the first segment extends. The third segments extend along the circumference of the central portion 21. Each of the third segments is connected to two second segments at the two ends thereof, respectively, in the direction in which the third segment extends. The third segment is connected to the first segment at the center thereof in the direction in which the third segment extends.

Figure 13D:
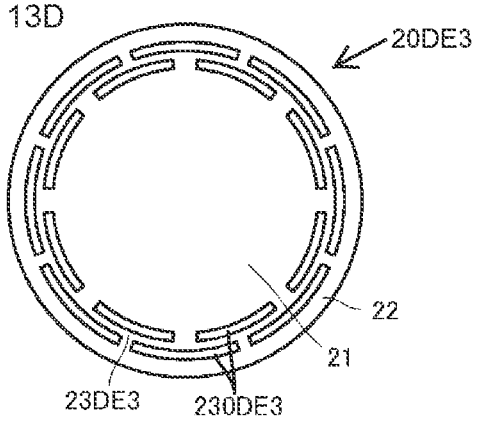
Figure 13B:
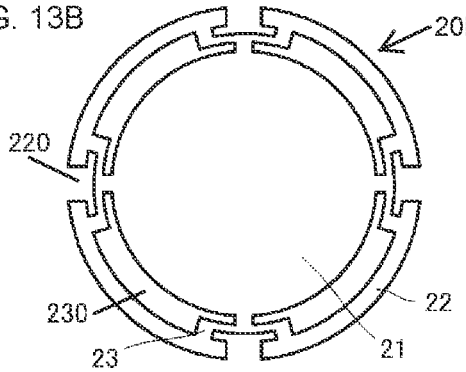

FIG. 13B illustrates a first major plate 20DE1, which is different from the first major plate 20 illustrated in FIG. 13A in the shape of the frame portion 22. The frame portion 22 has indentations 220 each provided between positions where the two second segments of a corresponding one of the supporting portions 23 are connected to the frame portion 22. The indentations 220 may be provided at any other positions of the frame portion 22, except the positions where the second segments of the supporting portions 23 are connected to the frame portion 22.

Figure 13E:
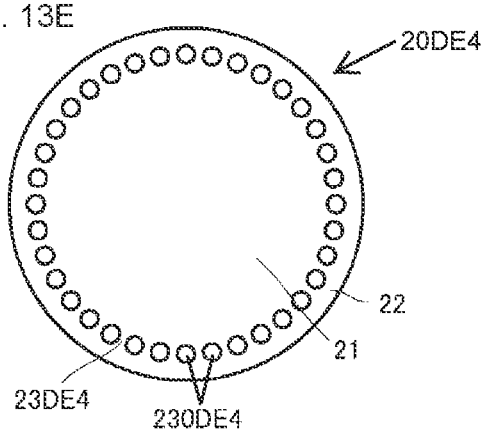
Figure 13C:
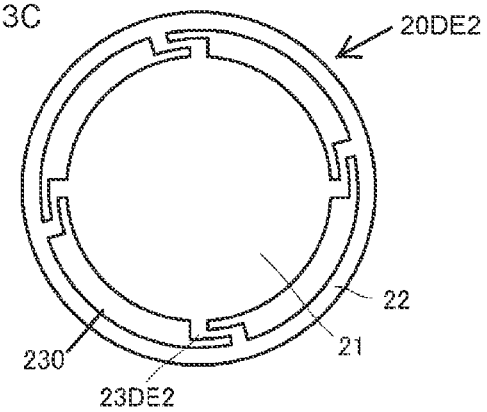

FIG. 13C illustrates a first major plate 20DE2, which is different from the first major plate 20 illustrated in FIG. 13A in the shape of the supporting portions, 23DE2. The supporting portions 23DE2 are each obtained by omitting one of the two second segments from the supporting portion 23.

FIG. 13D illustrates a first major plate 20DE3, which is different from the first major plate 20 illustrated in FIG. 13A in the shapes of the first openings, 230DE3, and the supporting portions, 23DE3. The first openings 230DE3 are obtained from two cuts having different diameters. The two cuts each extend through the first major plate 20 in the thickness direction of the first major plate 20. That is, the two cuts each connect the first major surface 211 and the second major surface 212. The two cuts are each sectioned into a plurality of cuts at a plurality of positions in the circumferential direction. The positions where the group of cuts on the inner side are sectioned are different from the positions where the group of cuts on the outer side are sectioned. The portions that section each of the two groups of cuts serve as the supporting portions 23DE3.

FIG. 13E illustrates a first major plate 20DE4, which is different from the first major plate 20 illustrated in FIG. 13A in the shapes of the first openings, 230DE4, and the supporting portions, 23DE4. The first openings 230DE4 are a plurality of through-holes arranged on the circumference of a circle. The portions between the plurality of through-holes serve as the supporting portions 23DE4.

In each of the above embodiments, the first film or the second film may include a portion that extends from the fixed end toward a side opposite to the movable portion. Such a configuration also includes the configuration according to the present disclosure and produces the advantageous effects produced by the present disclosure.

The configurations according to the above embodiments may be combined according to need. Such combinations each produce the corresponding advantageous effects.

10, 10A, 10B, 10C1, 10C2, 10D, 10E, 10F, 10G, 10H: fluid control apparatus
20, 20A, 20DE1, 20DE2, 20DE3, 20DE4, 20G: first major plate
21, 21A, 21G: central portion
22: frame portion
23, 23DE2, 23DE3, 23DE4: supporting portion
30: piezoelectric device
40, 40B: second major plate
50: peripheral plate
61, 61H: first film
62: second film
71, 71H, 72: fixing member
100: pump chamber
101: first space
102: second space
211: first major surface
212: second major surface
230, 230DE3, 230DE4: first opening
251: first region
252: second region
400: second opening
401: third major surface
402: fourth major surface
411, 412: recess
611, 621: movable end
612, 622: fixed end
N21, N21*o*: node

The invention claimed is:

1. A fluid control apparatus comprising:

a first major plate having a first major surface and a second major surface;

a second major plate having a third major surface and a fourth major surface, the third major surface facing the first major surface;

a peripheral plate connecting the first major plate and the second major plate to each other; and a pump chamber enclosed by the first major plate, the second major plate, and the peripheral plate, wherein the first major plate includes a central portion; a frame portion provided around a circumference of the central portion; at least one supporting portion connected to the frame portion and to the central portion and supporting the central portion such that the central portion is vibratable; and a first opening provided between the central portion and the frame portion and connecting the pump chamber and an outside area near the second major surface to each other, wherein the second major plate includes a second opening connecting the pump chamber and an outside area near the fourth major surface to each other, wherein the fluid control apparatus further includes a piezoelectric device provided on the central portion and configured to vibrate the central portion;

a first film provided on the first major surface, wherein the first film has a first movable portion, and one end of the first movable portion serves as a first movable end; and a second film provided on the third major surface, wherein the second film has a second movable portion, and one end of the second movable portion serves as a second movable end, and wherein the first film and the second film are positioned between the first opening and the second opening.

2. The fluid control apparatus according to claim 1, wherein the first movable portion of the first film and the second movable portion of the second film coincide with or overlap each other when seen in a direction orthogonal to the major surfaces.

3. The fluid control apparatus according to claim 1, wherein the first film has a first fixed end fixed to the first major plate, and the second film has a second fixed end fixed to the second major plate, and wherein a length of the first movable portion of the first film between the first fixed end and the first movable end and a length of the second movable portion of the second film between the second fixed end and the second movable end are substantially equal.

4. The fluid control apparatus according to claim 1, wherein the first film has a first fixed end fixed to the first major plate, and the second film has a second fixed end fixed to the second major plate, and wherein the first fixed end of the first film is an inner end of the first movable portion of the first film, and wherein the second fixed end of the second film is an inner end of the second movable portion of the second film.

5. The fluid control apparatus according to claim 4, wherein the first movable end of the first film and the second movable end of the second film are each positioned closer to the peripheral plate than an outermost node of vibration of the central portion.

6. The fluid control apparatus according to claim 5, wherein the first movable end of the first film and the second movable end of the second film are each positioned on an inner side with respect to the first opening in plan view.

7. The fluid control apparatus according to claim 1, wherein the first film has a first fixed end fixed to the first major plate, and the second film has a second fixed end fixed to the second major plate, and wherein the first fixed end of the first film is an outer end of the first movable portion of the first film, and wherein the second fixed end of the second film is an outer end of the second movable portion of the second film.

8. The fluid control apparatus according to claim 1, wherein the first film has a first fixed end fixed to the first major plate, and the second film has a second fixed end fixed to the second major plate, and wherein a sum of a length of the first movable portion of the first film between the first fixed end and the first movable end and a length of the second movable portion of the second film between the second fixed end and the second movable end is greater than or equal to a distance between the first major surface and the third major surface.

9. The fluid control apparatus according to claim 8, wherein the sum of the length of the first movable portion of the first film between the first fixed end and the first movable end and the length of the second movable portion of the second film between the second fixed end and the second movable end is substantially equal to the distance between the first major surface and the third major surface.

10. The fluid control apparatus according to claim 1, wherein an average thickness of the central portion is greater in a region on a center side with respect to an outermost node of vibration of the central portion than in a region on an outer side with respect to the outermost node.

11. The fluid control apparatus according to claim 1, wherein the at least one supporting portion includes a plurality of supporting portions provided between the central portion and the frame portion, and wherein the first opening is provided between the central portion and the frame portion and between each adjacent pair of the plurality of supporting portions.

12. The fluid control apparatus according to claim 2, wherein the first film has a first fixed end fixed to the first major plate, and the second film has a second fixed end fixed to the second major plate, and wherein a length of the first movable portion of the first film between the first fixed end and the first movable end and a length of the second movable portion of the second film between the second fixed end and the second movable end are substantially equal.

13. The fluid control apparatus according to claim 2, wherein the first film has a first fixed end fixed to the first major plate, and the second film has a second fixed end fixed to the second major plate, and wherein the first fixed end of the first film is an inner end of the first movable portion of the first film, and wherein the second fixed end of the second film is an inner end of the second movable portion of the second film.

14. The fluid control apparatus according to claim 3, wherein the first fixed end of the first film is an inner end of the first movable portion of the first film, and wherein the second fixed end of the second film is an inner end of the second movable portion of the second film.

15. The fluid control apparatus according to claim 2, wherein the first film has a first fixed end fixed to the first major plate, and the second film has a second fixed end fixed to the second major plate, and wherein the first fixed end of the first film is an outer end of the first movable portion of the first film, and wherein the second fixed end of the second film is an outer end of the second movable portion of the second film.

16. The fluid control apparatus according to claim 3, wherein the first fixed end of the first film is an outer end of the first movable portion of the first film, and wherein the second fixed end of the second film is an outer end of the second movable portion of the second film.

17. The fluid control apparatus according to claim 2, wherein the first film has a first fixed end fixed to the first major plate, and the second film has a second fixed end fixed to the second major plate, and wherein a sum of a length of the first movable portion of the first film between the first fixed end and the first movable end and a length of the second movable portion of the second film between the second fixed end and the second movable end is greater than or equal to a distance between the first major surface and the third major surface.

18. The fluid control apparatus according to claim 3, wherein a sum of a length of the first movable portion of the first film between the first fixed end and the first movable end and a length of the second movable portion of the second film between the second fixed end and the second movable end is greater than or equal to a distance between the first major surface and the third major surface.

19. The fluid control apparatus according to claim 4, wherein a sum of a length of the first movable portion of the first film between the first fixed end and the first movable end and a length of the second movable portion of the second film between the second fixed end and the second movable end is greater than or equal to a distance between the first major surface and the third major surface.

20. The fluid control apparatus according to claim 5, wherein the first film has a first fixed end fixed to the first major plate, and the second film has a second fixed end fixed to the second major plate, and wherein a sum of a length of the first movable portion of the first film between the first fixed end and the first movable end and a length of the second movable portion of the second film between the second fixed end and the second movable end is greater than or equal to a distance between the first major surface and the third major surface.

* * * * *